US009287665B2

(12) United States Patent
Watanabe

(10) Patent No.: US 9,287,665 B2
(45) Date of Patent: Mar. 15, 2016

(54) INCORRECT INSERTION PREVENTION STRUCTURE OF CONNECTOR AND THE CONNECTOR

(71) Applicant: FUJITSU LIMITED, Kawasaki-shi, Kanagawa (JP)

(72) Inventor: Takashi Watanabe, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 37 days.

(21) Appl. No.: 14/456,179

(22) Filed: Aug. 11, 2014

(65) Prior Publication Data

US 2015/0118874 A1 Apr. 30, 2015

(30) Foreign Application Priority Data

Oct. 30, 2013 (JP) ..... 2013-225689

(51) Int. Cl.

| | |
|---|---|
| ***H01R 13/453*** | (2006.01) |
| ***H01R 13/64*** | (2006.01) |
| *H01R 13/62* | (2006.01) |
| *H01R 24/62* | (2011.01) |

(52) U.S. Cl.

CPC ..... *H01R 13/64* (2013.01); *H01R 13/4536* (2013.01); *H01R 13/6205* (2013.01); *H01R 24/62* (2013.01)

(58) Field of Classification Search

CPC ..... H01R 13/4536; H01R 13/4532
USPC ..... 439/677, 38
See application file for complete search history.

(56) References Cited

U.S. PATENT DOCUMENTS

| | | | | |
|---|---|---|---|---|
| 2004/0178114 | A1 | 9/2004 | Natsuhara et al. | |
| 2009/0239392 | A1 | 9/2009 | Sumitomo et al. | |
| 2013/0017696 | A1 * | 1/2013 | Alvarez Rivera .... | H01R 13/447 439/142 |

FOREIGN PATENT DOCUMENTS

| | | |
|---|---|---|
| JP | 2003-150911 | 5/2003 |
| JP | 2004-047367 | 2/2004 |
| JP | 2004-247387 | 9/2004 |
| JP | 2009-231114 | 10/2009 |

* cited by examiner

*Primary Examiner* — Tulsidas C Patel
*Assistant Examiner* — Marcus Harcum
(74) *Attorney, Agent, or Firm* — Staas & Halsey LLP

(57) ABSTRACT

An incorrect-insertion-prevention structure of a connector which prevents a first connector from being incorrectly inserted into a space formed within a second connector to be fitted to the first connector, wherein the first connector includes at least one first magnet, a bottom surface or a side surface at an insertion end to be inserted into the second connector, wherein the second connector includes: a shutter rotatably and pivotally supported by a rotating shaft to open and close an inlet of the space, and a shutter-rotation-prevention unit rotatably and pivotally supported by a supporting shaft in parallel to the rotating shaft of the shutter to prevent the shutter from being rotated in an opening direction, and wherein the shutter-rotation-prevention unit shutter-rotation-prevention unit includes: at least one engaging member facing a rotation end of the shutter in a closed state to prevent the shutter from being moved in the opening direction.

15 Claims, 12 Drawing Sheets

INCORRECT INSERTION PREVENTION STRUCTURE OF CONNECTOR AND THE CONNECTOR

CROSS-REFERENCE TO RELATED APPLICATIONS

This application is based upon and claims the benefit of priority from the prior Japanese Patent Application No. 2013-225689 filed on Oct. 30, 2013, the entire contents of which are incorporated herein by reference.

FIELD

The embodiments discussed herein are related to an incorrect insertion prevention structure of a connector and the connector.

BACKGROUND

In a case where signals are transmitted and received between two units, male and female connectors with electrodes corresponding to the number of signals have conventionally been used. Meanwhile, when one device is provided with a plurality of connectors, signal transmission is not accurately carried out when matching connectors are not connected to each other. Therefore, there is an incorrect fitting prevention connector in which key pins are provided at one or more portions of a terminal portion of one side connector, and holes, into which the key pins are inserted, are formed at the other side connector, so that the one side connector and the other side connector are not fitted to each other when the positions of the key pins do not correspond to the positions of the holes. In the incorrect fitting prevention connector as described above, since key pins are formed at empty pin positions of a connector, there is a limitation in the types of accurately fittable connectors. In addition, since the fitting is mechanical, key pins may be damaged when an incorrect connector is inserted.

In contrast, there is a connector which employs a fitting structure using an external shape of a connector without key pins. However, in this type of connector, since a difference in a physical shape is used, the combination of connectors is limited and only several different types may be coped with. Further, there is a problem in that a manufacturing cost is expensive because the shapes of the connectors are different from each other.

Therefore, Patent Document 1 discloses a connector in which magnets are provided in corresponding positions of a connector socket and a connector plug, and the corresponding magnets are attracted to each other only in matching connectors so as to connect the connectors to each other. Patent Document 2 discloses a connector in which connector pins themselves are formed of magnets, and connection is made only when polarities of magnets at seven positions are completely opposite to polarities of corresponding magnets.

[Patent Document 1] Japanese Laid-Open Patent Publication No. 2009-231114.

[Patent Document 2] Japanese Laid-Open Patent Publication No. 2004-247387.

SUMMARY

However, in the connector disclosed in Patent Document 1, the magnets are small. Thus, even when an incorrect connector is inserted and a corresponding magnet is repulsive, forced insertion may be made due to a weak repulsive force. In addition, the connector disclosed in Patent Document 2 has a problem in that a cost is increased because the number of used magnets is large, and the shape is complicated. Thus, what is required is an incorrect insertion prevention structure of a connector and the connector with the structure in which a plurality of connectors are identifiable to prevent incorrect insertion, connector shapes are identical, and the connector pins are not broken even if enforced insertion is made. Hereinafter, the term "incorrect insertion prevention structure of a connector" will be referred to as "incorrect insertion prevention structure" for the convenience of description.

According to an aspect of the embodiments, an incorrect-insertion-prevention structure of a connector which prevents a first connector from being incorrectly inserted into a space formed within a second connector to be fitted to the first connector, wherein the first connector includes at least one first magnet, a bottom surface or a side surface at an insertion end to be inserted into the second connector, wherein the second connector includes: a shutter rotatably and pivotally supported by a rotating shaft to open and close an inlet of the space, and a shutter-rotation-prevention unit rotatably and pivotally supported by a supporting shaft in parallel to the rotating shaft of the shutter to prevent the shutter from being rotated in an opening direction, and wherein the shutter-rotation-prevention unit shutter-rotation-prevention unit includes: at least one engaging member facing a rotation end of the shutter in a closed state to prevent the shutter from being moved in the opening direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, detailed descriptions will be made on specific exemplary embodiments of an incorrect insertion prevention structure and a connector provided with the structure according to the present disclosure with reference to accompanying drawings. Meanwhile, the incorrect insertion prevention structure of the present disclosure is provided at both the female connector and the male connector, and is not formed at only any one of the connectors.

Figure 1A:
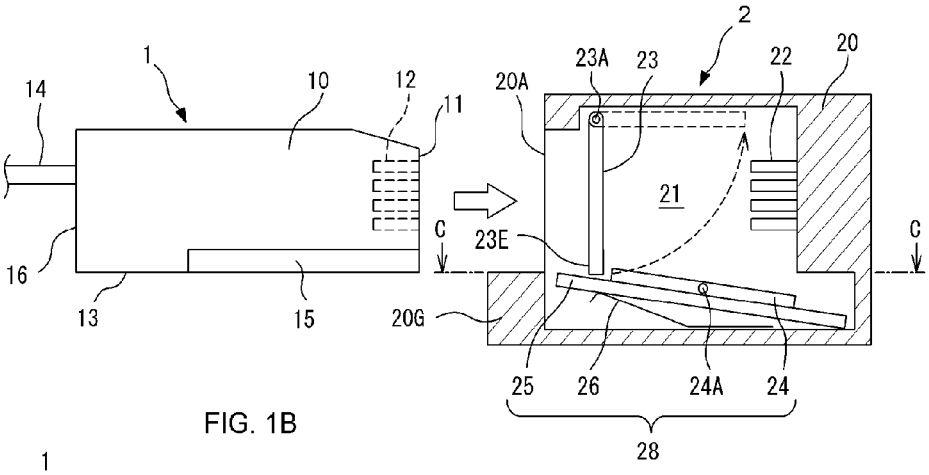
FIG. 1A is a cross-sectional view illustrating a state where female and male connectors provided with an incorrect insertion prevention structure of a first exemplary embodiment of the present disclosure before they are fitted to each other.

FIG. 1A illustrates a state where a female connector 1 (a first connector) and a male connector 2 (a second connector) provided with an incorrect insertion prevention structure of a first exemplary embodiment of the present disclosure before they are fitted to each other. The female connector 1 is inserted into a space 21 of the male connector 2 to be coupled with the male connector 2. The incorrect insertion prevention structure includes magnets 15 which are provided in the female connector 1, and a shutter 23, engaging members 24, magnets 25, and springs 26 which are provided in the male connector 2. As for the magnets 15 and the magnets 25, for example, permanent magnets may be used.

First, the structure of the female connector 1 will be described with reference to FIGS. 1A and 1B. A plurality of sockets 12 configured to receive pins provided at the male connector side is provided on the front surface of the housing of the female connector 1. A cable 14 connected to the sockets 12 is provided on a rear surface 16. In addition, two permanent magnets 15 are attached on a bottom surface 13. Each of the permanent magnets 15 has a rod shape, in which one end portion is formed as an N pole and the other end portion is formed as an S pole. Accordingly, when the number of the permanent magnets 15 is two, four types of female connectors 1 may be prepared depending on which one of the N pole and the S pole of each of the permanent magnets 15 is located at the front surface side.

Subsequently, a structure of the male connector 2 will be described with reference to FIGS. 1A, 1C, 1D and 1E. A space 21 is formed in the housing 20 of the male connector 2, and a plurality of pins 22 to be inserted into the sockets 12 of the female connector 1 is provided in the innermost portion of the space 21. FIG. 1A does not illustrates a terminal connected to the pins 22 to transmit signals to the outside of the housing 20. A shutter 23 configured to open and close the inlet of the space 21 is provided at the inlet of the space 21. The shutter 23 is pivotally supported by rotating shafts 23A provided on the upper portion of the space 21 to shut the inlet of the space 21, and, upon being pressed, to be rotated and open the inlet. When the shutter 23 rotates and moves into the space 21, a rotation end 23E of the shutter 23 is not abutted on the pins 22.

Meanwhile, a guide member 20G is provided at the inlet 20A of the space 21 of the housing 20 to guide the female connector 1 into the space 21 of the male connector 2. The female connector 1 slides on the guide member 20G, comes in contact with the shutter 23, pushes and opens the shutter 23, and then enters the inside of the space 21. A shutter rotation prevention unit 28 is provided at a portion (a bottom surface) positioned lower than the top surface of the guide member 20G in the space 21 so as to prevent the shutter 23 from being rotated into the space 21. The shutter rotation prevention unit 28 includes an engaging member 24, a permanent magnet 25, and a spring 26.

The engaging member 24 is configured to be rotatable by rotating shafts 24A which are provided at the bottom surface side of the housing 20 to be in parallel to the rotating shafts 23A of the shutter 23. The permanent magnet 25 is attached on the rear surface of the engaging member 24. A spring 26 is provided on the bottom surface of the housing 20 to support the permanent magnet 25 so that one end of the engaging member 24 is located on the rear surface of the rotation end 23E of the shutter 23.

Figure 1B:
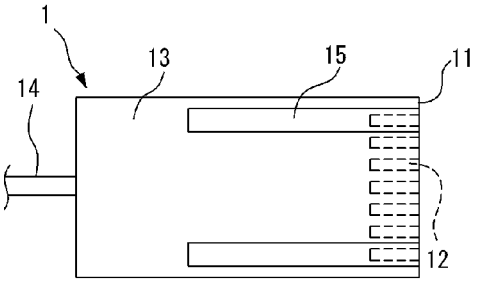
FIG. 1B is a bottom planview illustrating the female connector illustrated in FIG. 1A.
Figure 1C:
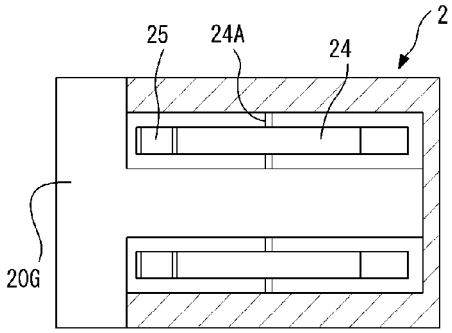
FIG. 1C is a cross-sectional view taken along line C-C in FIG. 1A.
Figure 1D:
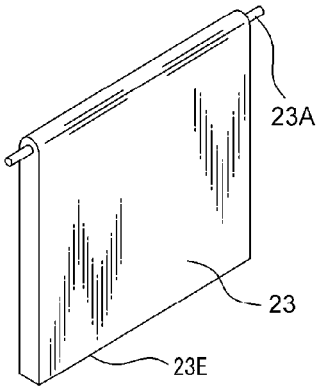
FIG. 1D is a perspective view illustrating a single structure of a shutter illustrated in FIG. 1A.
Figure 1E:
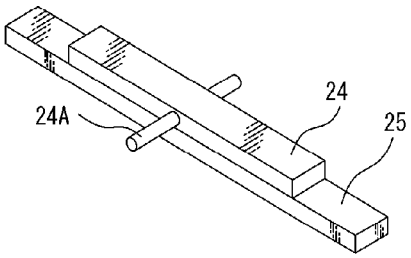
FIG. 1E is a perspective view illustrating a shutter rotation prevention unit illustrated in FIG. 1A, and a permanent magnet attached on the shutter rotation prevention unit.

FIG. 1D illustrates a structure of the shutter 23, and FIG. 1E illustrates the permanent magnet 25 attached on the rear surface of the engaging member 24. The rotating shafts 24A are provided at both lateral sides of the center of the engaging member 24, and the full length of the permanent magnet 25 attached on the rear surface of the engaging member 24 is longer than the full length of the engaging member 24. In the present exemplary embodiment, the lengths of the permanent magnet 25 protruding from both ends of the engaging member 24 are the same. Accordingly, as illustrated in FIG. 1A, in a state where the rear surface of the permanent magnet 25 is supported by the spring 26, and the one end of the engaging member 24 is located on the rear surface of the rotation end 23E of the shutter 23, the front end portion of the permanent magnet 25 is exposed to the outside of the shutter 23 through the outside of the rotation end 23E of the shutter 23.

The positions of the front end portions of the permanent magnets 25 exposed to the outside of the shutter 23 are substantially the same as that of the female connector 1 when the female connector 1 comes close to a position where the female connector 1 is abutted on the shutter 23. The female connector side permanent magnets 15 and the male connector side permanent magnets 25 are spaced apart from each other by a distance that allows each permanent magnet not to be affected by other than a permanent magnet positioned to face the permanent magnet in the counterpart connector. The widthwise distance between the permanent magnets 15 or 25 in each connector is set to be larger than the vertical distance between the permanent magnets 15 and the permanent magnets 25 of both connectors when both side connectors come closest to each other so that the permanent magnets 15 or 25 in each connector are not affected by each other.

The number of the shutter rotation prevention units 28 equals to the number of the permanent magnets 15 provided in the female connector 1. The width of each permanent magnet 25 in the shutter rotation prevention unit 28 equals to the width of each permanent magnet 15 in the female connector 1. Further, the positions of the front end portions of the permanent magnets 25 exposed to the outside of the shutter 23 correspond to the positions of the permanent magnets 15 provided on the bottom surface of the female connector 1 when the female connector 1 comes close to the male connector 2. The magnetic pole of each permanent magnet 25 exposed to the outside of the shutter 23 is an N pole or an S pole.

When the permanent magnets 15 provided in the female connector 1 and the permanent magnets 25 provided in the male connector 2 have the same polarities when the female connector 1 is inserted into the male connector 2, a biasing force acts on the springs 26 from a repulsive force acting between the permanent magnets 15 and the permanent magnets 25. The springs 26 have a biasing force enough to be bent by the biasing force acting on the springs 26. Accordingly, when the permanent magnets 15 and the permanent magnets 25 have the same polarities, the permanent magnets 25 moves to the bottom side of the housing 20 by the repulsive force to rotate the engaging member 24 around the rotating shafts 24A. As a result, one end of each engaging member 24 is moved from the rear surface position of the rotation end 23E of the shutter 23.

Hereinafter, descriptions will be made on a connector identification operation of the incorrect insertion prevention structure when the female connector is not correct for the male connector (does not correspond to the male connector) when the female connector 1 configured as illustrated in FIGS. 1A and 1B is inserted into the male connector 2 configured as illustrated in FIGS. 1A, 1C to 1E. When the female connector does not correspond to the male connector, the polarities of the permanent magnets 15 provided in the female connector 1 do not coincide with the polarities of the permanent magnets 25 exposed to the outside of the shutter 23 of the male connector 2.

Figure 2A:
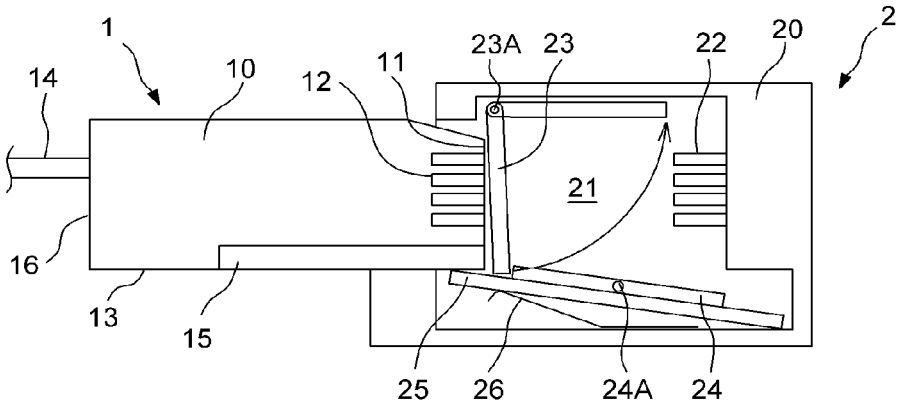
FIG. 2A is a cross-sectional view illustrating a state where the female connector is abutted on the shutter of the male connector illustrated in FIG. 1A.

FIG. 2A illustrates a case where the female connector 1 intended to be inserted into the male connector 2 is not correct. In this case, the polarity of the permanent magnet 15 provided in the female connector 1 does not coincide with the polarity of the permanent magnet 25 provided in the male connector. For example, in a case where both polarities of the two permanent magnets 15 provided in the female connector 1, at the front surface side of the housing 10, are N poles, and both polarities of the permanent magnets 25 exposed to the outside of the shutter 23 are S poles, when the female connector 1 comes close to the male connector 2, the permanent magnets 15 and the permanent magnets 25 attract each other. This may also be applied to a case where both magnetic polarities of the two permanent magnets 15 provided in the female connector 1, at the front surface side of the housing 10, are S poles, and both polarities of the permanent magnets 25 exposed to the outside of the shutter 23 are N poles.

As a result, each permanent magnet 25 maintains its position taken until now, and thus one end of each engaging member 24 is still located at the rear surface of the rotation end 23E of the shutter 23. In this state, even when the shutter 23 is pressed by the front surface 11 of the female connector 1 to insert the female connector 1 into the male connector 2, the shutter 23 is not opened because the rear surface side of the rotation end 23E of the shutter 23 is abutted on one end of the engaging member 24. Accordingly, the female connector 1 cannot be inserted into the male connector 2 and thus incorrect insertion can be prevented.

The above described example corresponds to a case where both magnetic polarities of the two permanent magnets 15 provided in the female connector 1, at the front surface side of the housing 10, are N poles (or S poles), and both polarities of the permanent magnets 25 exposed to the outside of the shutter 23 are S poles (or N poles). Meanwhile, there is a case where one side magnetic polarity of the two permanent magnets 15 provided in the female connector 1, at the front surface side of the housing 10, is an N pole, and the other side polarity is an S pole, and one side polarity of the permanent magnets 25 exposed to the outside of the shutter 23 is an S pole, and the other side polarity is an N pole. In this case, there are three combinations of polarities of the permanent magnets 15 and the permanent magnets 25 facing each other when the female connector 1 comes close to the male connector 2; (A) facing polarities at both sides are different from each other, (B) facing polarities at only one side are different from each other, and (C) facing polarities at both sides are the same.

In the case (A), the two permanent magnets 15 and 25 attract each other. Thus, each permanent magnet 25 maintains its position taken until now, and thus one end of each engaging member 24 is still located on the rear surface of the rotation end 23E of the shutter 23. Accordingly, even when the shutter 23 is pressed by the front surface 11 of the female connector 1, the shutter 23 is not opened. Accordingly, the female connector 1 cannot be inserted into the male connector 2 and thus, incorrect insertion can be prevented.

In the case (B), between the two pairs of permanent magnets 15 and 25, the magnets of the pair having different polarities attract each other, and the magnets of the pair having the same polarities repel each other. Accordingly, at the side where the polarity of the permanent magnet 25 is different from that of the permanent magnet 15, the permanent magnet 25 maintains its position taken until now, but at the side where the polarity of the permanent magnet 25 is the same as that of the permanent magnet 15, the permanent magnet 25 is moved and one end of the engaging member 24 is moved to a position retracted from the rear surface of the rotation end 23E of the shutter 23. However, at the side where the polarity of the permanent magnet 25 is different from that of the permanent magnet 15, the permanent magnet 25 is not moved, and one end of the engaging member 24 is still located on the rear surface of the rotation end 23E of the shutter 23. Thus, even when the shutter 23 is pressed by the front surface 11 of the female connector 1, the shutter 23 is not opened. Accordingly, the female connector 1 cannot be inserted into the male connector 2 and incorrect insertion can be prevented. The case (C) will be described later.

Hereinafter, descriptions will be made on a connector identification operation of the incorrect insertion prevention structure in a case where the female connector 1 configured as illustrated in FIGS. 1A and 1B is inserted into the male connector 2 configured as illustrated in FIGS. 1A, 1C to 1E, when the female connector is correct for the male connector (corresponds to the male connector). When the female connector corresponds to the male connector, the polarities of the permanent magnets 15 provided in the female connector 1 coincide with the polarities of the permanent magnets 25 exposed to the outside of the shutter 23 of the male connector 2.

Figure 2B:
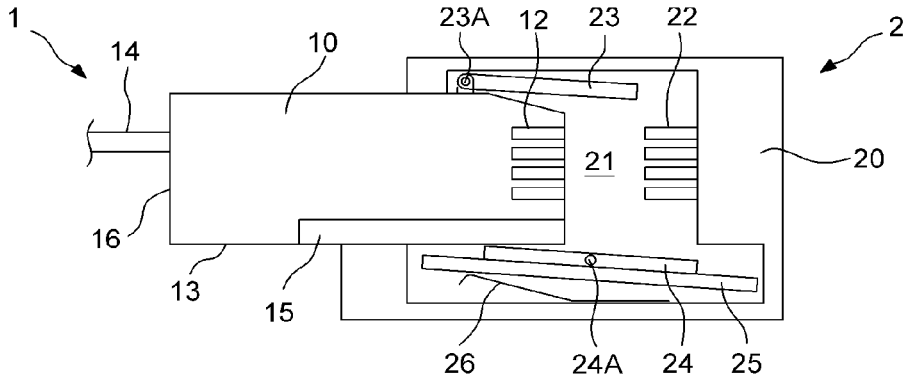
FIG. 2B is a cross-sectional view illustrating a state where the female connector is inserted into the space of the male connector while the shutter rotation prevention unit is moved from the state illustrated in FIG. 2A.
Figure 2C:
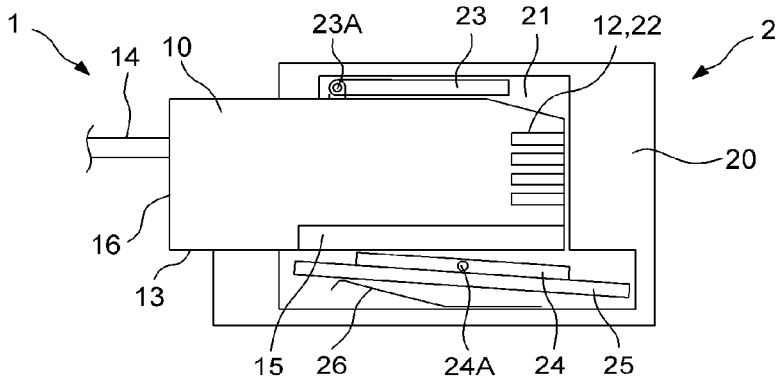
FIG. 2C is a cross-sectional view illustrating a state where the female and male connectors are fitted to each other while the female connector is further inserted from the state illustrated in FIG. 2B.

FIG. 2B illustrates a case where the female connector 1 intended to be inserted into the male connector 2 is correct. In this case, the polarities of the permanent magnets 15 provided in the female connector 1 coincide with the polarities of the permanent magnets 25 provided in the male connector. For example, in a case where both polarities of the two permanent magnets 15 provided in the female connector 1, at the front surface side of the housing 10, are N poles, and both polarities of the permanent magnets 25 exposed to the outside of the shutter 23 are N poles, when the female connector 1 comes close to the male connector 2, the permanent magnets 15 and the permanent magnets 25 repel each other. This may also be applied to a case where both magnetic polarities of the two permanent magnets 15 provided in the female connector 1, at the front surface side of the housing 10, are S poles, and both polarities of the permanent magnets 25 exposed to the outside of the shutter 23 are S poles.

As a result, each permanent magnet 25 moves from the position taken until now so that one end of each engaging member 24 is moved to a position where the one end does not face the rear surface of the rotation end 23E of the shutter 23. In this state, when the shutter 23 is pressed by the front surface 11 of the female connector 1 to insert the female connector 1 into the male connector 2, the shutter 23 is opened because the rear surface side of the rotation end 23E of the shutter 23 is not abutted on the one end of the engaging member 24. Accordingly, the female connector 1 may be moved into the space 21 of the male connector 2 while rotating the shutter 23. When the female connector 1 is inserted into the male connector 2 as it is, the female connector 1 and the male connector 2 are fitted to each other because the pins 22 of the male connector 2 are inserted into the sockets 12 of the female connector 1 as illustrated in FIG. 2B.

The above described example corresponds to a case where both magnetic polarities of the two permanent magnets 15 provided in the female connector 1, at the front side of the housing 10, are N poles (or S poles), and both polarities of the permanent magnets 25 exposed to the outside of the shutter 23 are N poles (or S poles). Meanwhile, when one side magnetic polarity of the two permanent magnets 15 provided in the female connector 1, at the front surface side of the housing 10, is an N pole, and the other side polarity is an S pole, and one side polarity of the permanent magnets 25 exposed to the outside of the shutter 23 is an S pole, and the other side polarity is an N pole, the above described three combinations may be made. Because the cases (A) and (B) have already been described, the case (C) will be described below.

In the case (C), the two pairs of permanent magnets 15 and 25 repel each other. Thus, each permanent magnet 25 moves from the position taken until now so that one end of each engaging member 24 is moved to a position where the one end does not face the rear surface of the rotation end 23E of the shutter 23. In this state, when the shutter 23 is pressed by the front surface 11 of the female connector 1 to insert the female connector 1 into the male connector 2, the rear surface side of the rotation end 23E of the shutter 23 is not abutted on the one end of the engaging member 24, and the shutter 23 is opened. Accordingly, the female connector 1 may be moved into the space 21 of the male connector 2 while rotating the shutter 23. When the female connector 1 is inserted into the male connector 2 as it is, the female connector 1 and the male connector 2 are fitted to each other, because the pins 22 of the male connector 2 are inserted into the sockets 12 of the female connector 1 as illustrated in FIG. 2B.

Figure 3:
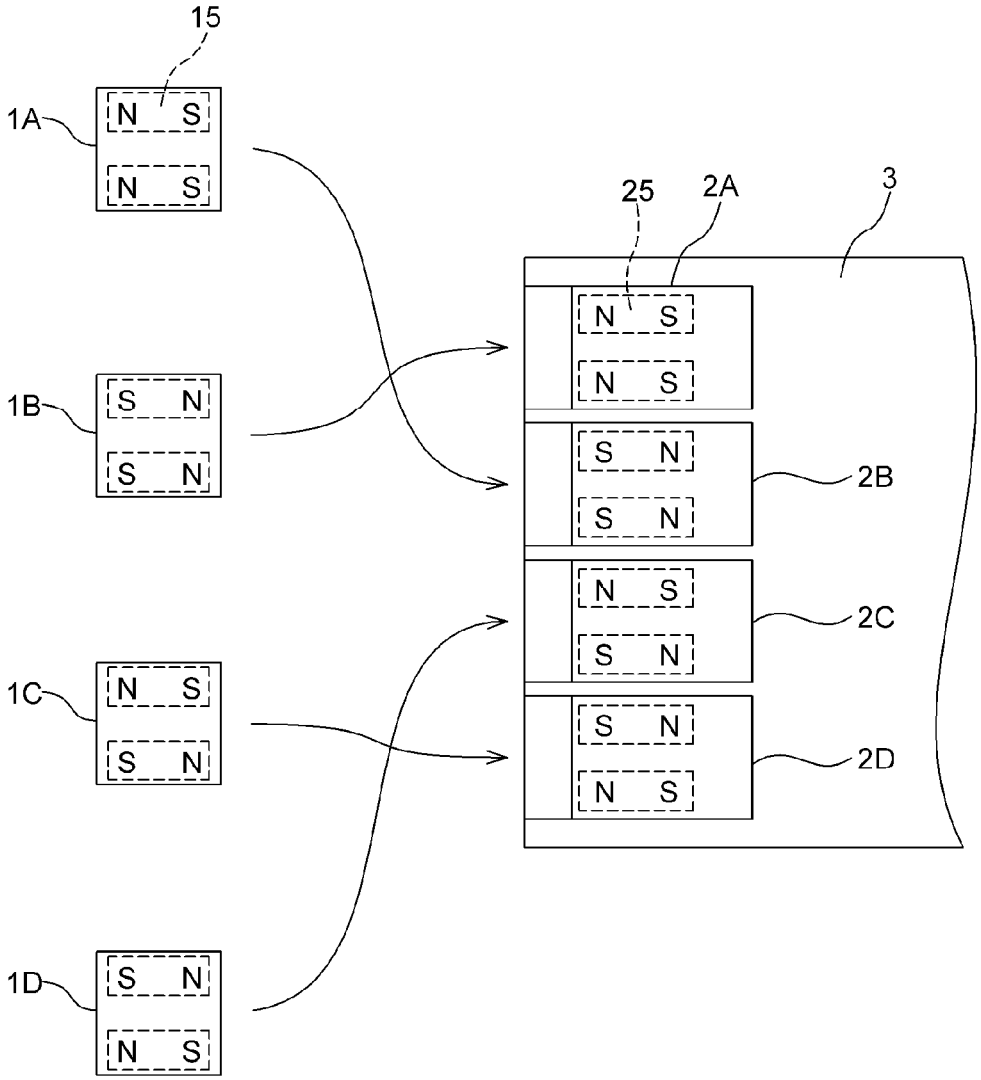
FIG. 3 is an explanatory view illustrating types of connectors, and combinations of fittable connectors, in a case where two permanent magnets are attached to each of female and male connectors.

FIG. 3 is an explanatory view illustrating types of connectors, and combinations of fittable connectors, in a case where the two permanent magnets 15 are attached to the female connector 1, and the two permanent magnets 25 are attached to the male connector 2. When the two permanent magnets 15 are attached to the female connector 1, four types of female connectors 1A, 1B, 1C and 1D may be provided according to the combinations of the magnetic poles of the permanent magnets 15. Likewise, when the two permanent magnets 25 are attached to the male connector 2, four types of male connectors 2A, 2B, 2C and 2D may be provided according to the combinations of the magnetic poles of the permanent magnets 25. The male connectors 2A, 2B, 2C and 2D are mounted on a substrate 3 in the present exemplary embodiment.

As described above, a combination which enables the female connector 1 to be fitted to the male connector 2 is that the polarities of the permanent magnets 15 attached to the female connector 1 completely coincide with polarities of the permanent magnets 25 attached to the male connector 2. Thus, the female connector 1A may be fitted only to the male connector 2B. Likewise, the female connector 1B may be fitted only to the male connector 2A, the female connector 1C may be fitted only to the male connector 2D, and the female connector 1D may be fitted only to the male connector 2C. In this manner, when the two permanent magnets are attached to each female connector 1 and each male connector 2, four types of connectors may be identified to prevent incorrect insertion.

Figure 4A:
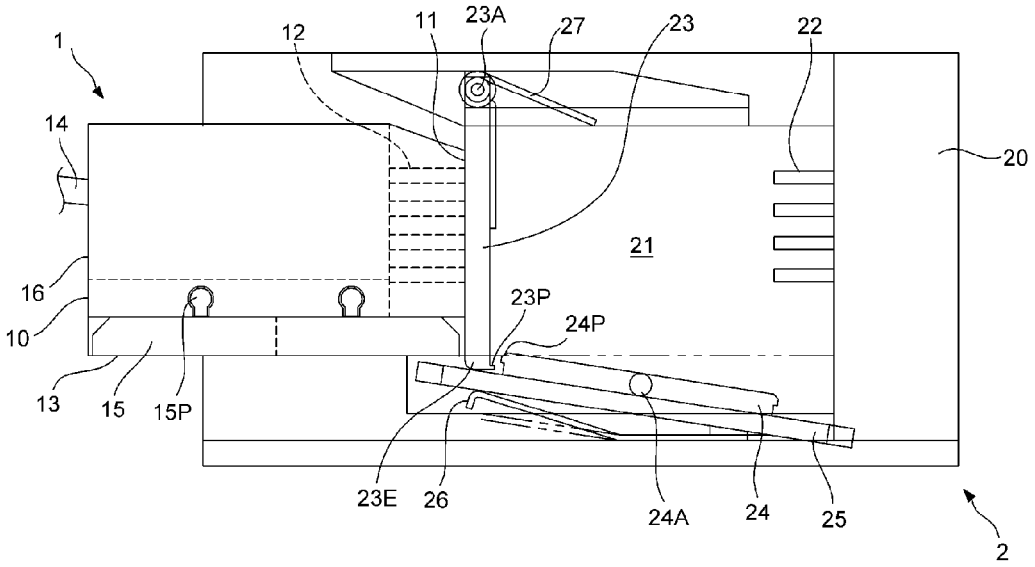
FIG. 4A is a side elevational view illustrating female and male connectors provided with an incorrect insertion prevention structure of a second exemplary embodiment of the present disclosure.
Figure 4B:
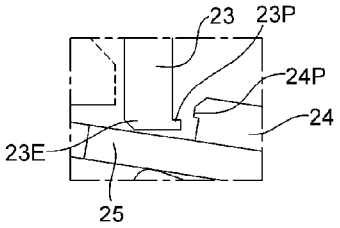
FIG. 4B is a view illustrating a part of a rotation end of a shutter and a front end portion of an engaging member as illustrated in FIG. 4A in an enlarged scale.

FIG. 4A illustrates the state where female and male connectors provided with an incorrect insertion prevention structure of a second exemplary embodiment of the present disclosure just before they are fitted to each other. In the second exemplary embodiment, some elements of the incorrect insertion prevention structure which are the same as those in the first exemplary embodiment are given the same reference numerals in the drawings, and detailed descriptions thereof will be omitted. In the incorrect insertion prevention structure of the second exemplary embodiment, an engaging projection 23P is formed on the rotation end 23E of the shutter 23, and at the same time, an engaging projection 24P is also formed on the front end portion of the engaging member 24 of the shutter rotation prevention unit 28. FIG. 4B is a view illustrating a part of the rotation end 23E of the shutter 23 and the front end portion of the engaging member 24 as illustrated in FIG. 4A in an enlarged scale. In a case where the engaging projection 23P is formed on the rotation end 23E of the shutter 23, and the engaging projection 24P is formed on the front end portion of the engaging member 24, when the shutter 23 is rotated while the engaging member 24 is not moved, the engaging projection 24P is engaged with the engaging projection 23P, thereby securely suppressing rotation.

Figure 9A:
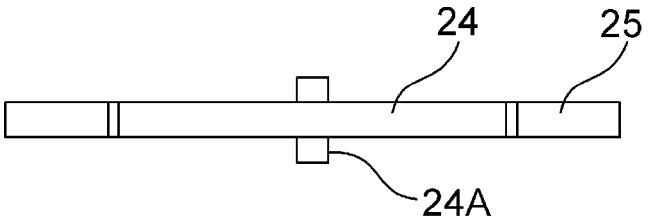
FIG. 9A is a top plan view illustrating the engaging member and the permanent magnet formed in the male connector.
Figure 9C:
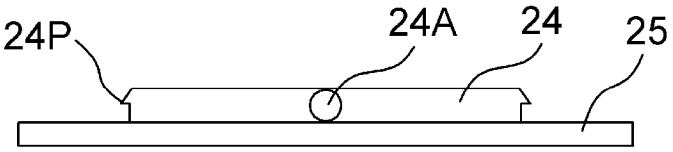
FIG. 9C is a side elevational view illustrating the engaging member and the permanent magnet.
Figure 9B:
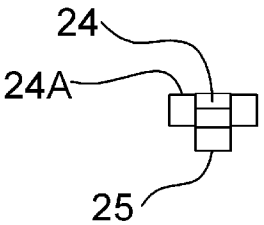
FIG. 9B is a front elevational view illustrating the engaging member and the permanent magnet.

FIG. 9A is a top plan view illustrating the engaging member 24 and the permanent magnet 25 provided in the male connector 2 with the incorrect insertion prevention structure of the second exemplary embodiment, FIG. 9B is a front elevational view illustrating the engaging member 24 and the permanent magnet 25, and FIG. 9C is a side elevational view illustrating the engaging member 24 and the permanent magnet 25. The engaging member 24 and the permanent magnet 25 are bonded to each other, and the permanent magnet 25 is formed in a rod shape and is longer than the engaging member 24. The method of bonding the engaging member 24 to the permanent magnet 25 is not particularly limited. The lengths from the rotating shaft 24A to both ends of the engaging member 24 are the same, and the lengths from the rotating shaft 24A to both ends of the permanent magnet 25 are the same. The clamping projections 24P are formed at both ends of the engaging member 24. Accordingly, regardless of which pole side (an N pole side or an S pole side) of the permanent magnet 25 is placed at the shutter 23 side, the pair of the engaging member 24 and the permanent magnet 25 stacked as illustrated in FIGS. 9A and 9B may be commonly used.

Meanwhile, in the incorrect insertion prevention structure of the second exemplary embodiment, a coil spring 27 attached to the rotating shaft 23A of the shutter 23 is illustrated. The coil spring 27 is configured to fix the shutter 23 to the inlet of the space 21. When the shutter 23 is pressed from the outside in a state where the engaging member 24 is moved, the coil spring 27 is rotated together with the shutter 23 and provides a biasing force to return the shutter 23 to its original position. The coil spring 27 is also provided in the incorrect insertion prevention structure of the first exemplary embodiment which has been described with reference to FIGS. 1A to 2C.

Figure 8A:
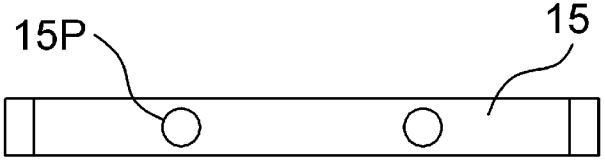
FIG. 8A is a top plan view illustrating a permanent magnet attached to the bottom surface of a female connector.
Figure 8C:
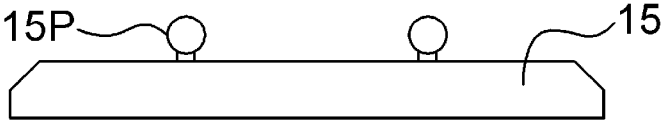
FIG. 8C is a side elevational view illustrating the permanent magnet.
Figure 8B:
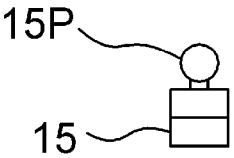
FIG. 8B is a front elevational view illustrating the permanent magnet.

In the exemplary embodiment illustrated in FIG. 4A, a permanent magnet 15 is fitted into the bottom surface 13 of the housing 10 of the female connector 1 by mounting protrusions 15P. FIGS. 8A to 8C illustrate a top plan view, a side elevational view, and a front elevational view of a permanent magnet 15 formed with the mounting protrusions 15P. The mounting surface portions of the both side ends of the permanent magnet 15 of the present exemplary embodiment are chamfered. The mounting protrusions 15P may be made of a resin, and may be embedded in the permanent magnet 15. A flat permanent magnet 15 may be adhered to the bottom surface 13 of the housing 10 of the female connector 1 by an adhesive. A resin cover may cover the surroundings of a permanent magnet 15, and a mounting protrusion 15P may be formed integrally with the cover.

Figure 5A:
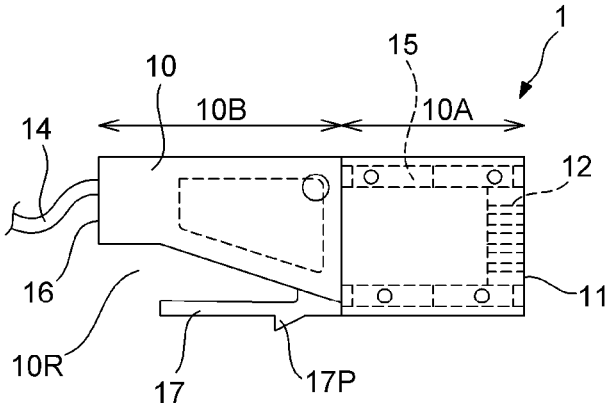
FIG. 5A is a top plan view of a female connector provided with an incorrect insertion prevention structure of a third exemplary embodiment of the present disclosure.
Figure 5B:
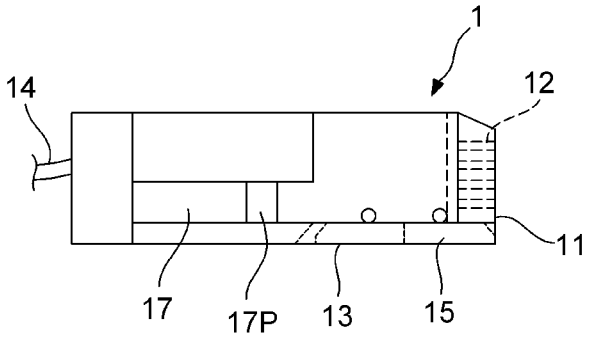
FIG. 5B is a side elevational view illustrating the female connector illustrated in FIG. 5A.
Figure 5C:
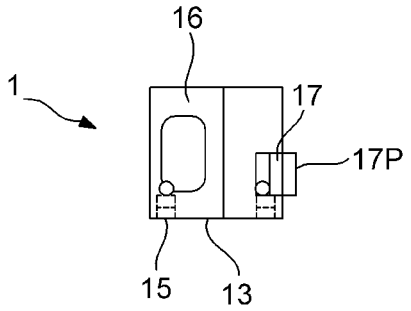
FIG. 5C is a rear elevational view illustrating the female connector illustrated in FIG. 5A.
Figure 6A:
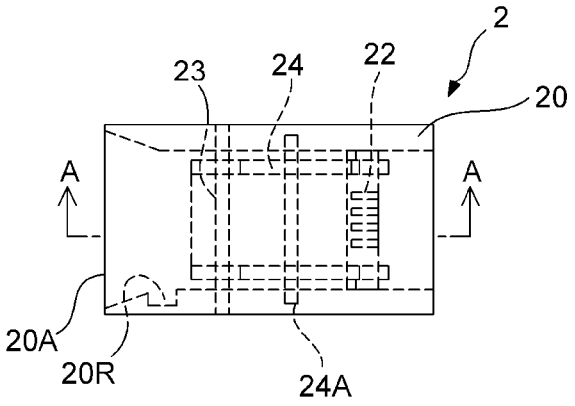
FIG. 6A is a top plan view illustrating a male connector corresponding to the female connector illustrated in FIG. 5A.
Figure 6B:
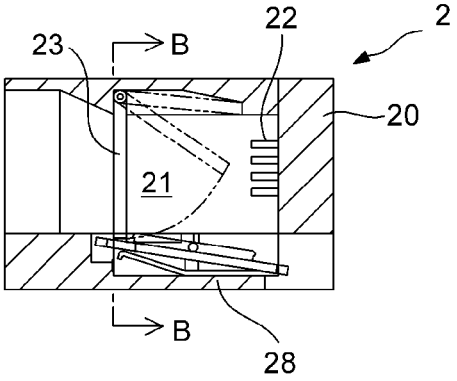
FIG. 6B is a cross-sectional view taken along line A-A in FIG. 6A.
Figure 6C:
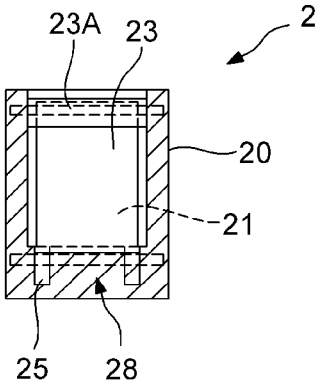
FIG. 6C is a cross-sectional view taken along line B-B in FIG. 6B.

FIG. 5A is a top plan view illustrating the female connector 1 provided with the incorrect insertion prevention structure of the third exemplary embodiment of the present disclosure, FIG. 5B is a side elevational view illustrating the female connector 1 illustrated in FIG. 5A, and FIG. 5C is a rear elevational view illustrating the female connector 1 illustrated in FIG. 5A. FIG. 6A is a top plan view illustrating the male connector 2 corresponding to the female connector 1 illustrated in FIG. 5A, FIG. 6B is a cross-sectional view taken along line A-A in FIG. 6A, and FIG. 6C is a cross-sectional view taken along line B-B in FIG. 6B. In the third exemplary embodiment, some elements of the incorrect insertion prevention structure which are the same as those in the first and second exemplary embodiments are given the same reference numerals in the drawings, and detailed descriptions thereof will be omitted.

In the incorrect insertion prevention structure of the third exemplary embodiment, the housing 10 of the female connector 1 is divided into a fitting portion 10A at the front surface 11 side, and a removal portion 10B at the rear surface 16 side. Sockets 12 are provided on the front surface 11 of the fitting portion 10A, and two permanent magnets 15 are provided on the bottom surface 13. A removal arm 17 is provided on one side surface of the removal portion 10B, and an engaging projection 17P is formed in the middle of the removal arm 17. A notch 10R is formed on the rear surface 16 side surface of the removal portion 10B to allow the removal arm 17 to be moved. The removal arm 17 may be formed to be integrally with the housing 10 made of a resin. Meanwhile, in FIG. 5C, the cable 14 is not illustrated.

An engaging recess 20R configured to receive the engaging projection 17P of the removal arm 17 provided in the female connector 1 is formed in the vicinity of the inlet 20A of the housing 20 of the male connector 2. The shutter 23 provided in the space 21 within the housing 20 of the male connector 2 and the shutter rotation prevention unit 28 of the shutter 23 have the same structures as those in the incorrect insertion prevention structure of the first exemplary embodiment which has been described with reference to FIGS. 1A to 2C.

Figure 7A:
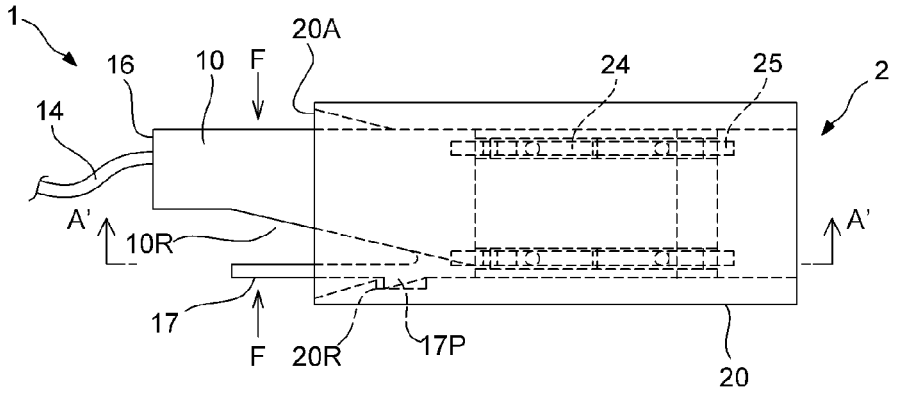
FIG. 7A is a top plan view illustrating a state where the female connector illustrated in FIG. 5A is fitted to the male connector illustrated in FIG. 6A.
Figure 7B:
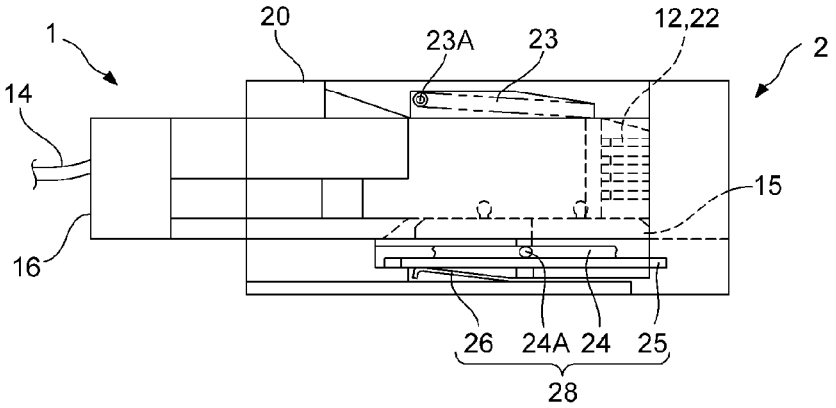
FIG. 7B is a cross-sectional view taken along line A'-A' of FIG. 7A.
Figure 7C:
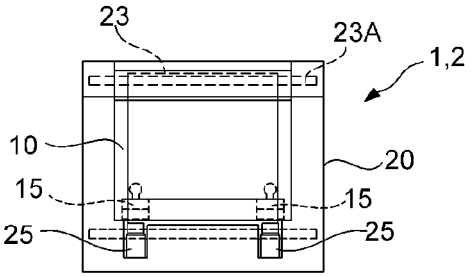
FIG. 7C is a rear elevational view illustrating the female and male connectors illustrated in FIG. 7A.

FIG. 7A is a top plan view illustrating the state where the female connector 1 illustrated in FIG. 5A is fitted to the male connector 2 illustrated in FIG. 6A, FIG. 7B is a cross-sectional view taken along line A'-A' in FIG. 7A, and FIG. 7C is a rear elevational view illustrating the state where the female and male connectors 1 and 2 illustrated in FIG. 7A are fitted to each other. In a state where the female connector 1 is fitted to the male connector 2, the engaging projection 17P formed on the removal arm 17 is received in the engaging recess 20R formed in the vicinity of the inlet 20A of the housing 20, and thus, the female connector 1 is not separated from the male connector 2. In a state where the female connector 1 is fitted to the male connector 2, the shutter 23 is located at the ceiling portion of the housing 20, and the permanent magnet 25 faces the permanent magnet 15 provided in the female connector 1 while biasing the spring 26.

When the female connector 1 is detached from the male connector 2, the portion indicated by arrow F-F in FIG. 7A is gripped with fingers to move the free end of the removal arm 17 into the notch 10R of the housing 10. Then, the engaging projection 17P escapes from the engaging recess 20R of the housing 20. Thus, in this state, the female connector 1 may be pulled out from the male connector 2. When the female connector 1 is detached from the male connector 2, the shutter 23 is returned to a position where the shutter 23 shuts the inlet 20A by a coil spring (not illustrated), and the permanent magnet 25 of the shutter rotation prevention unit 28 is biased by the spring 26 so that the end portion of the engaging member 24 is returned to a position where the rotation of the shutter 23 is prevented.

Figure 10A:
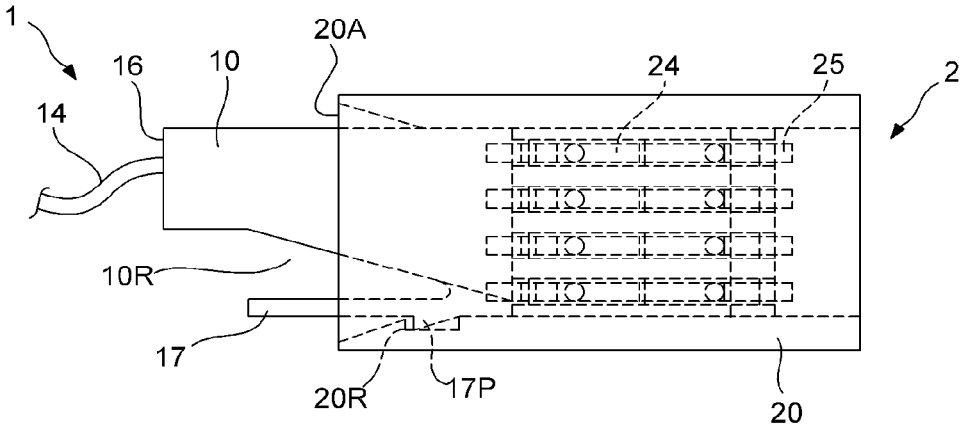
FIG. 10A is a top plan view illustrating the state where female and male connectors provided with an incorrect insertion prevention structure of a fourth exemplary embodiment of the present disclosure are fitted to each other.
Figure 10B:
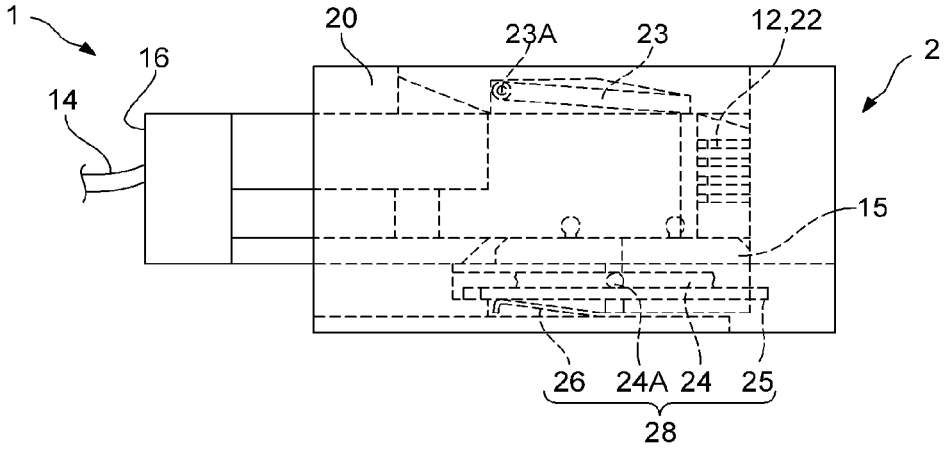
FIG. 10B is a side elevational view of the female connector illustrated in FIG. 10A.
Figure 10C:
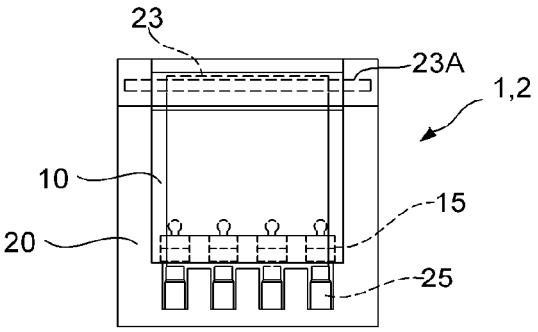
FIG. 10C is a rear elevational view of the female connector illustrated in FIG. 10A.

FIG. 10A is a top plan view illustrating the state where a female connector 1 and a male connector 2 provided with an incorrect insertion prevention structure of a fourth exemplary embodiment of the present disclosure are fitted to each other. FIG. 10B is a side elevational view illustrating the state where the female connector 1 and the male connector 2 illustrated in FIG. 10A are fitted to each other, and FIG. 10C is a rear elevational view illustrating the state where the female connector 1 and the male connector 2 illustrated in FIG. 10A are fitted to each other. The structures of the female connector 1 and the male connector 2 provided with the incorrect insertion prevention structure of the fourth exemplary embodiment are basically the same as those of the female connector 1 and the male connector 2 provided with the incorrect insertion prevention structure of the third exemplary embodiment which has been described with reference to FIGS. 5A to 7C. Accordingly, FIG. 10A corresponds to FIG. 7A, FIG. 10B corresponds to FIG. 7B, and FIG. 10C corresponds to FIG. 7C.

The female connector 1 and the male connector 2 provided with the incorrect insertion prevention structure of the fourth exemplary embodiment are different from the female connector 1 and the male connector 2 provided with the incorrect insertion prevention structure of the third exemplary embodiment in terms of the number of permanent magnets 15 and 25 provided in the female connector 1 and the male connector 2. In the incorrect insertion prevention structure of the third exemplary embodiment, each of the number of the permanent magnets 15 and the number of the permanent magnet 25, which are respectively provided in the female connector 1 and the male connector 2, is two. Meanwhile, in the incorrect insertion prevention structure of the fourth exemplary embodiment, four permanent magnets 15 are provided on the bottom surface of the housing 10 of the female connector 1. In addition, four permanent magnets 25 are provided in the bottom portion of the space 21 of the housing 20 of the male connector 2 at positions which correspond to the four permanent magnets 15 provided in the female connector 1, respectively.

As described above, when four permanent magnets 15 are provided on the bottom surface of the housing 10 of the female connector 1, and four permanent magnets 25 are provided in the bottom portion of the space 21 of the housing 20 of the male connector 2, 16 types of the female connectors 1 and the male connectors 2 are present. When the female connector 1 and the male connector 2 provided with the incorrect insertion prevention structure of the fourth exemplary embodiment are fitted to each other, the polarities of the four permanent magnets 15 have to completely coincide with the polarities of the four permanent magnets 25.

Figure 11:
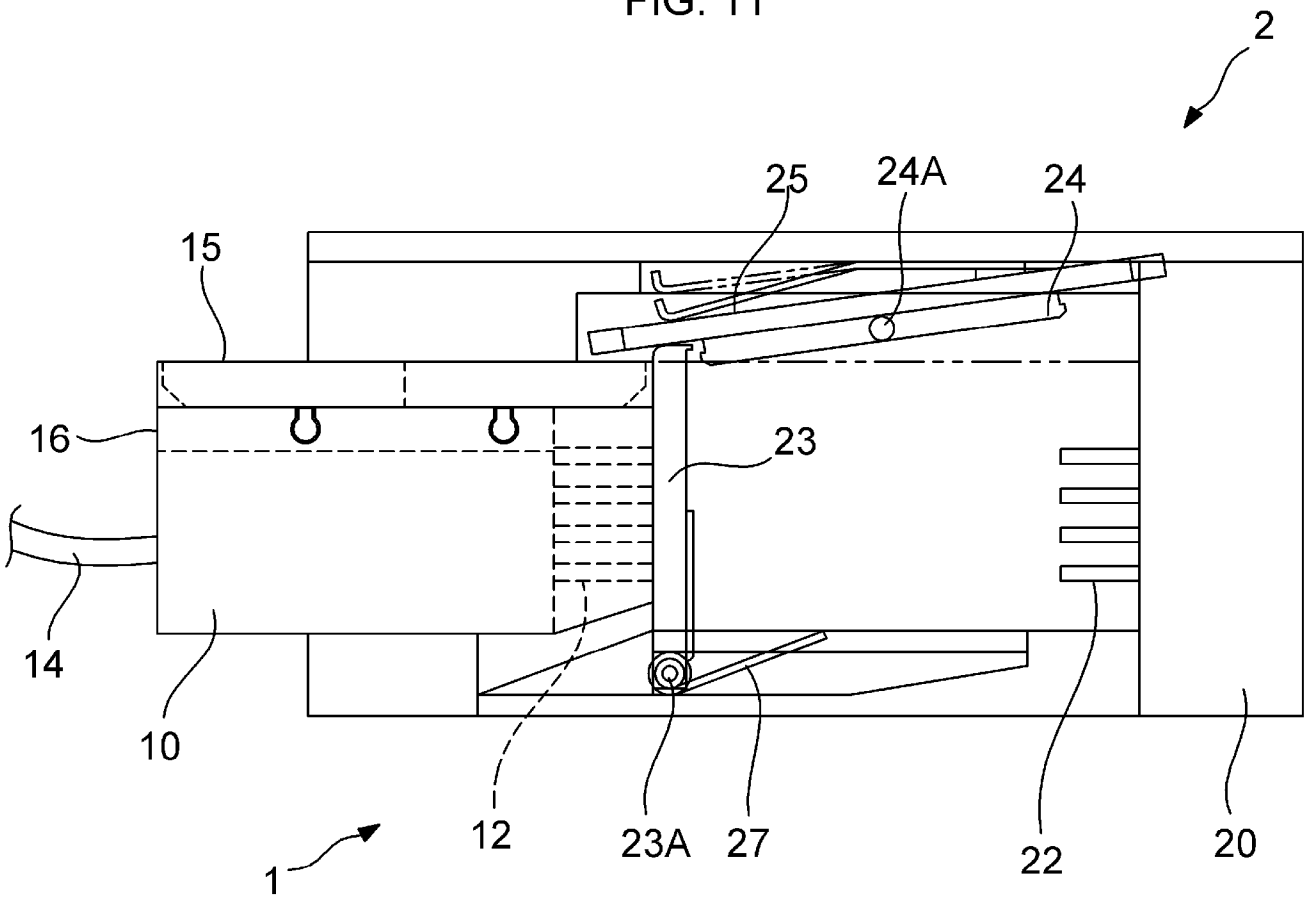
FIG. 11 is a side elevational view of female and male connectors provided with an incorrect insertion prevention structure of a fifth exemplary embodiment of the present disclosure.

FIG. 11 is a side elevational view illustrating the state where a female connector 1 and a male connector 2 provided with an incorrect insertion prevention structure of a fifth exemplary embodiment of the present disclosure are fitted to each other. In the incorrect insertion prevention structure of the first to fourth exemplary embodiments, the rotating shaft 23A of the shutter 23 is provided in the upper portion of the space 21 within the housing 20 of the male connector 2, and the shutter rotation prevention unit 28 is provided in the lower portion. Meanwhile, the incorrect insertion prevention structure of the fifth exemplary embodiment is different from that of the first to fourth exemplary embodiments in that the rotating shaft 23A of the shutter 23 is provided in the lower portion of the space 21 within the housing 20 of the male connector 2, and the shutter rotation prevention unit 28 is provided in the upper portion. Accordingly, in the female connector 1, the permanent magnet 15 is provided on the upper surface of the housing 10.

The structures of the shutter 23 and the shutter rotation prevention unit 28 at the male connector 2 side and the structure of the permanent magnet 15 at the female connector 1 side in the incorrect insertion prevention structure in the fifth exemplary embodiment are the same as those in the first to fourth exemplary embodiments. Thus, some elements which are the same as those in the first to fourth exemplary embodiments are given the same reference numerals in drawings, and detailed descriptions thereof will be omitted. As described above, in the incorrect insertion prevention structure of the present disclosure, the shutter 23 and the shutter rotation prevention unit 28 at the male connector 2 side may be provided on any surfaces of the space 21 as long as they are provided on facing surfaces.

Figure 12:
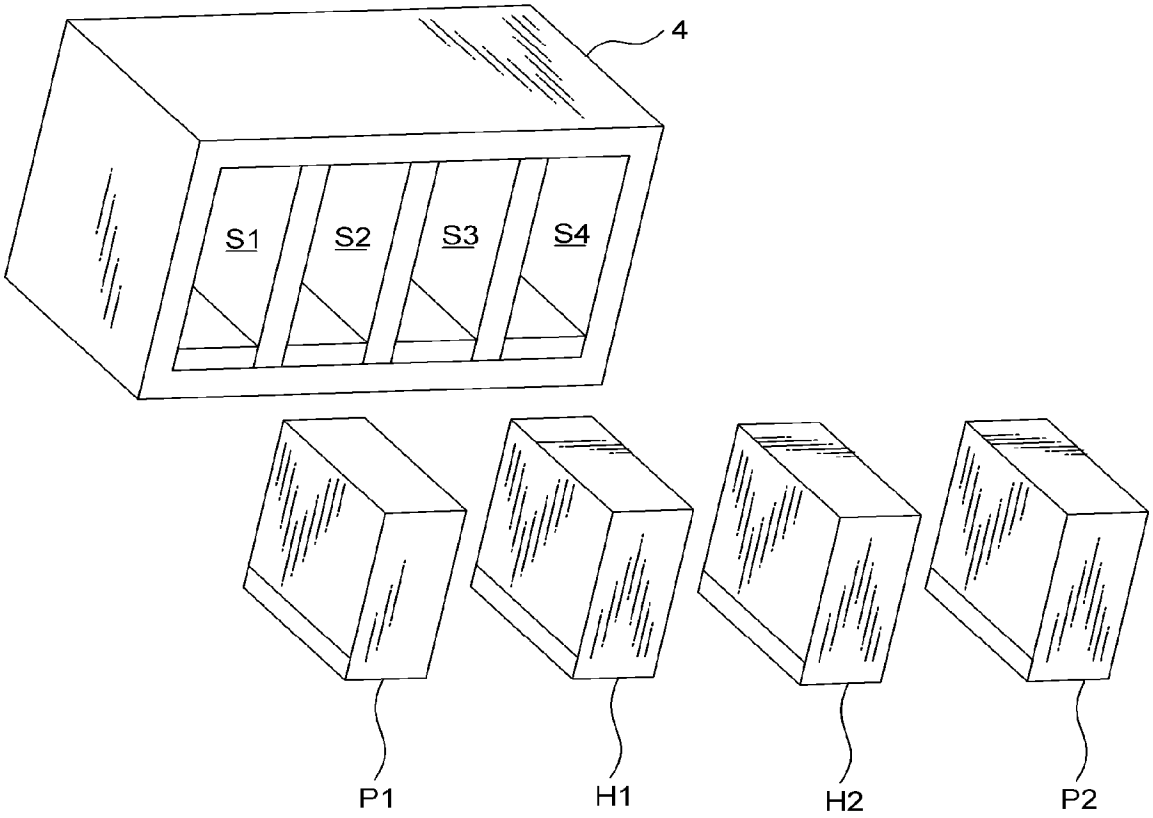
FIG. 12 is a perspective view illustrating a unit shelf provided with an incorrect insertion prevention structure of a sixth exemplary embodiment of the present disclosure, and power supply units and HDD units to be mounted in the unit shelf.

FIG. 12 illustrates a unit shelf 4 provided with an incorrect insertion prevention structure of a sixth exemplary embodiment of the present disclosure, and two power supply units P1 and P2 and two HDD units H1 and H2 to be mounted in the unit shelf 4. It is assumed that four slots S1, S2, S3 and S4 are provided in the unit shelf 4, and the power supply unit P1 is mounted in the slot S1, the HDD unit H1 is mounted in the slot S2, the HDD unit H2 is mounted in the slot S3, and the power supply unit P2 is mounted in the slot S4. When the connectors provided with the incorrect insertion prevention structure of the present disclosure are used in the power supply units P1 and P2, and the HDD units H1 and H2, the power supply units P1 and P2 and the HDD units H1 and H2 cannot be fitted to connectors unless the polarities of the connectors coincide with the connectors of the power supply units P1 and P2 and the HDD units H1 and H2. Accordingly, the two power supply units P1 and P2 and the two HDD units H1 and H2 are mounted in the unit shelf 4 without concern about incorrect insertion.

As described above, according to the present disclosure, a plurality of connectors having structures which are not fittable with the same structure may be prepared. Thus, an incorrect insertion prevention structure may be established without a burden on a connector terminal portion. In addition, since a magnetic force of a permanent magnet is used, the incorrect insertion prevention structure may be structurally simple, and may be simply set so that occurrence of, for example, a rearrangement, may be coped with.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention has (have) been described in detail, it should be understood that the various changes, substitutions, and alterations could be made hereto without departing from the spirit and scope of the invention.

What is claimed is:

1. An incorrect insertion prevention structure for a connector assembly comprising:

a first connector, a second connector, wherein the first connector is prevented from being incorrectly inserted into a space formed within the second connector to be fitted to the first connector, wherein the first connector includes at least one first magnet located on a surface, at an insertion end to be inserted into the second connector, wherein the second connector includes: a shutter rotatably and pivotally supported by a rotating shaft to open and close an inlet of the space, and a shutter rotation prevention unit rotatably and pivotally supported by a supporting shaft in parallel to the rotating shaft of the shutter to prevent the shutter from being rotated in an opening direction, and wherein the shutter rotation prevention unit includes: at least one engaging member facing a rotation end of the shutter in a closed state to prevent the shutter from being moved in the opening direction, and at least one second magnet having a magnetic field which is set to control a rotation of the shutter rotation prevention unit by acting together with a magnetic field of the first magnet; and wherein the first connector is prevented from insertion into the space of the second connector if the polarity of the first magnet is opposite the polarity of the second magnet, and the first connector is not prevented from insertion into the space of the second connector if the polarity of the first magnet is the same as the polarity of the second magnet.

2. The incorrect insertion prevention structure according to claim 1, wherein the engaging member is rotatably and pivotally supported by the supporting shaft in parallel to the rotating shaft of the shutter and is biased by a biasing member to be located at a position facing the rotation end of the shutter in the closed state, and the second magnet has a front end portion which protrudes to an outside of the space beyond the rotation end of the shutter in the closed state.

3. The incorrect insertion prevention structure according to claim 2, wherein a biasing force of the biasing member is set to be smaller than a repulsive force between the first magnet and the second magnet in a case where a polarity of the first magnet coincides with a polarity of the second magnet when the first connector is inserted into the second connector.

4. The incorrect insertion prevention structure according to claim 1, wherein the first magnet is provided on a bottom surface of the first connector, the rotating shaft of the shutter is provided at a ceiling surface side of the inlet, the shutter rotation prevention unit is provided at a bottom surface side of the inlet, the second magnet is longer than the engaging member, and the engaging member is placed on the second magnet.

5. The incorrect insertion prevention structure according to claim 1, wherein the first magnet is provided on an upper surface of the first connector, the rotating shaft of the shutter is provided at a bottom surface side of the inlet, the shutter rotation prevention unit is provided at a ceiling surface side of the inlet, the second magnet is longer than the engaging member, and the engaging member is placed under the second magnet.

6. The incorrect insertion prevention structure according to claim 1, wherein the first magnet and the second magnet are rod shaped magnets, each of the first and second magnets has a S pole and a N pole at respective ends thereof.

7. The incorrect insertion prevention structure according to claim 1, wherein the second magnet is provided integrally with the engaging member so that a middle position between a S pole and a N pole becomes a position of the supporting shaft of the engaging member.

8. The incorrect insertion prevention structure according to claim 5, wherein a biasing member is provided on the rotating shaft of the shutter to locate the shutter at a position where the shutter shuts the inlet.

9. The incorrect insertion prevention structure according to claim 1, wherein a first engaging projection is formed to protrude at the rotation end of the shutter to protrude to the space side, and a second engaging projection is formed to protrude at a front end portion of the engaging member to engage with the first engaging projection.

10. The incorrect insertion prevention structure according to claim 1, wherein the inlet is formed with a locking groove, and the first connector is provided with a locking projection to be retracted in the locking groove when the first connector is fitted to the second connector, and a lever configured to disengage the locking projection from the locking groove.

11. The incorrect insertion prevention structure according to claim 2, wherein a magnetic pole of the first magnet at the insertion end side of the first connector is located at a position facing a protruding portion of the second magnet before the insertion end of the first connector is abutted on the shutter.

12. A connector assembly which is provided with an incorrect insertion prevention structure which prevents a first connector from being incorrectly inserted into a space formed within a second connector to be fitted to the first connector, wherein in the incorrect insertion prevention structure, the first connector includes at least one first magnet located on a surface, at an insertion end to be inserted into the second connector, wherein the second connector includes: a shutter rotatably and pivotally supported by a rotating shaft to open and close an inlet of the space, and a shutter rotation prevention unit rotatably and pivotally supported by a supporting shaft in parallel to the rotating shaft of the shutter to prevent the shutter from being rotated in an opening direction, and wherein the shutter rotation prevention unit includes at least one engaging member facing a rotation end of the shutter in a closed state to prevent the shutter from being moved in the opening direction, and at least one second magnet having a magnetic field which is set to control a rotation of the shutter rotation prevention unit by acting together with a magnetic field of the first magnet; and wherein the first connector is prevented from insertion into the space of the second connector if the polarity of the first magnet is opposite the polarity of the second magnet, and the first connector is not prevented from insertion into the space of the second connector if the polarity of the first magnet is the same as the polarity of the second magnet.

13. The connector assembly according to claim 12, wherein the engaging member is rotatably and pivotally supported by the supporting shaft in parallel to the rotating shaft of the shutter and is biased by a biasing member to be located at a position facing the rotation end of the shutter in the closed state, and the second magnet has a front end portion which protrudes to an outside of the space beyond the rotation end of the shutter in the closed state.

14. The connector assembly according to claim 13, wherein a biasing force of the biasing member is set to be smaller than a repulsive force between the first magnet and the second magnet in a case where a polarity of the first magnet coincides with a polarity of the second magnet when the first connector is inserted into the second connector.

15. The connector assembly according to claim 12, wherein the first magnet is provided on a bottom surface of the first connector, the rotating shaft of the shutter is provided at a ceiling surface side of the inlet, the shutter rotation prevention unit is provided at a bottom surface side of the inlet, the second magnet is longer than the engaging member, and the engaging member is placed on the second magnet.

* * * * *